US006347793B2

(12) United States Patent
Bredenberg et al.

(10) Patent No.: US 6,347,793 B2
(45) Date of Patent: Feb. 19, 2002

(54) METHOD AND APPARATUS FOR CONSTRAINING THE OPEN EDGE OF A SIGNATURE DURING TRANSFER

(75) Inventors: Paul Emmett Bredenberg, Portsmouth; Richard Daniel Curley, Dover, both of NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/736,622

(22) Filed: Dec. 14, 2000

Related U.S. Application Data

(62) Division of application No. 09/286,894, filed on Apr. 6, 1999, now Pat. No. 6,186,489.

(51) Int. Cl.[7] ..... B65H 85/00; B65H 5/02; B65H 25/00

(52) U.S. Cl. ..... 271/3.24; 271/227; 198/470.1; 198/644

(58) Field of Search ..... 271/3.24, 240, 271/227; 198/470.1, 644

(56) References Cited

U.S. PATENT DOCUMENTS 4,014,261 A * 3/1977 Becker ..... 101/230 X
4,815,870 A * 3/1989 Sparer et al. ..... 400/120 X
4,943,045 A * 7/1990 Van Horne et al. ..... 271/277
5,141,221 A * 8/1992 Mack et al. ..... 271/271 X
5,168,809 A * 12/1992 Becker ..... 101/408 X
5,180,461 A * 1/1993 Widmann ..... 156/216 X
5,265,858 A * 11/1993 Hobbs et al. ..... 271/11 X
5,904,351 A * 5/1999 Masek et al. ..... 271/277
6,189,489 B1 * 2/2001 Bredenburg et al. ..... 271/3.14

* cited by examiner

*Primary Examiner*—Donald P. Walsh
*Assistant Examiner*—Kenneth W Bower
(74) *Attorney, Agent, or Firm*—Kenyon & Kenyon

(57) ABSTRACT

An apparatus and method designed to eliminate dog-earring of the comers of the open edges of a folded signature or book without the need for the use of electrostatic adherence. A guide mechanism is provided between a tape drive, a divert cylinder and/or a deceleration drum. The guide mechanism is preferably located at the position of the open edges of the signature which is being transferred. The guide mechanism is preferably of a width which accommodates variations in the folded width of the folded signature or books. The guide mechanism includes a series of narrow slots, or micro-slots, across its width. The gripping devices which are located in the area of the guide mechanism include a series of narrow fingers, or micro-fingers, across their width. The micro-fingers of the gripping mechanisms are designed to pass through the micro-slots of the guide mechanism. The guide mechanism constrains movement of the open edge of the folded signature away from the transfer mechanism across any gap between transfer mechanisms, thereby preventing dog-earring of the open edges of the folded signatures or books as they are transferred between transfer mechanisms.

15 Claims, 5 Drawing Sheets

METHOD AND APPARATUS FOR CONSTRAINING THE OPEN EDGE OF A SIGNATURE DURING TRANSFER

CROSS REFERENCE TO RELATED APPLICATION

This application is a division of U.S. Ser. No. 09/286,894, filed Apr. 6, 1999 now U.S. Pat. No. 6,186,489.

BACKGROUND OF THE INVENTION

1. Field of the Invention

The present invention is directed to a method and apparatus for constraining an edge of a signature in a printing press. In particular, the present invention is directed to a method and apparatus which prevents dog-earring in the open edge of folded signatures which are created in a printing press apparatus, as the folded signatures are transferred between components in the printing press.

2. Description of the Prior Art

In printing presses which print on a continuous web of material, such as, for example, an offset printing press, it is known to cut the printed web into signatures and thereafter to fold the signatures into what are sometimes called books. A signature is a cut section of a web of material in a printing press, whereas a book is a signature that has been folded in one or more places. FIG. 6 is a representation of a signature S which has been folded into a book, and which has a closed or folded edge F and open edges O. Folded signatures S in the form of books are collated and bound together to form a printed product, such as a magazine.

In modern printing presses, it is necessary to cut the web into signatures and fold the signatures into books at very high rates of speed. Alternatively, the web can be folded first, and then the folded web cut into books. Various mechanisms are known for accurately cutting a printed web into signatures of relatively uniform size, and thereafter folding the signatures into books of relatively uniform size, all at high rates of speed. Various mechanisms are also known for folding a web, and thereafter accurately cutting the printed and folded web into books of relatively uniform size, also at high rates of speed.

In known printing press apparatuses, folded signatures in the form of books emerge from cutting and folding mechanisms via a tape drive. FIG. 4 is a side, cross-sectional view, and FIG. 5 a partial perspective view, of a prior art printing press in which a folded signature S emerges in a direction D from a cutting and folding mechanism M via a tape drive T The tape drive T includes one or more tapes or belts B, moving continuously in a direction d, which engage at least one side of the folded signature or book S and conveys it in a linear direction. Usually, the tape drive T will include a tape or belt B which overlaps the open edges O of the folded signature or book S and is of sufficient width so that variations in the folded width W of the folded signature or book S will result in the open edges O always projecting under the tape or belt B. That arrangement therefore ensures that the open edges O are held down by the tape or belt B, preventing dog-earring of the corners C of the open edges O.

The tape drive T in the prior art apparatus of FIG. 4 transfers the folded signature or book S to transfer device 101. The transfer device 101 may rotate in a direction R1, and include some mechanism to secure a folded signature or book S to its outer surface. The signature S shown in FIG. 4 is transferred by tape drive T to the outer circumference of the transfer device 101, and after traversing a gap G in an unconstrained manner, the leading edge l of signature S is gripped by a leading edge gripping mechanism 4, 5 which projects from the periphery of a deceleration drum 6 (the periphery of which is indicated in dashed lines) rotating in a direction R2.

One problem with the known folded signature or book transfer mechanism as shown in FIGS. 4 and 5 is that the comers C of the open edge O of the folded signatures or books S have a tendency to dog-ear during transfer from the tape drive T to the deceleration drum 6, from the tape drive T to the transfer device 101, or from the transfer device 101 to any other transfer mechanism, such as a downstream deceleration drum. Dog-earring is a condition where a corner C' or edge of a flexible sheet or signature bends or folds over in an undesirable manner, as shown in dashed lines in FIG. 6. One solution which has been used to reduce the occurrence of dog-earring of the folded signatures or books S during the transfer steps is to electrostatically charge the folded signatures or books S. In one prior art arrangement, the web passes over a folder and is folded in one or more places. The folded web is then electrostatically charged by producing a voltage across the folded web, and then the charged web is cut into folded signatures or books S. As a result, the charge on the folded signature or book S results in the sides of the folded signature or book S being electrostatically attracted, and adhered, to one another. This adhering of the two charged sides results in the open edges O adhering to one another, thereby increasing the thickness of the open edge O presented to the transfer mechanisms, and reducing the chance that a corner will be unrestrained and become dog-eared.

SUMMARY OF THE INVENTION

A disadvantage which has been discovered in the known use of electrostatic adherence to prevent dog-earring is that the electrostatic adherence can become a hindrance to subsequent operations on the folded signature or book S. For example, if it is desired to collate a series of folded signatures or books S by interleaving the folded signatures or books S to form a magazine, the open edges O of a folded signature or book S must be opened relative to one another to allow another folded signature or book to be inserted between them. However, the electrostatic adherence of the open edges O to one another hinders both the opening, and the interleaving, operations. Another problem with the use of electrostatic adherence is that it is not a positive control of the open edge O of the folded signature or book S, and therefore dog-earring can still occur despite the increased stiffness of the open edge O caused by the electrostatic adherence.

The present invention is an apparatus and method designed to eliminate dog-earring of the corners C of the open edges of a folded signature or book S without the need for the use of electrostatic adherence. The apparatus and method of the present invention, therefore, provides advantages over known transfer techniques because it does not present a potential hindrance to subsequent operations of the folded signatures or books S.

In the apparatus of the present invention, a guide mechanism is provided between, for example, a tape drive, a divert cylinder and/or a deceleration drum. The guide mechanism is preferably located at the position of the open edges of the signature which is being transferred, although additional guide mechanisms could be located in other positions as well. The guide mechanism is preferably of a width which accommodates variations in the folded width of the folded signature or books. The guide mechanism includes a series of narrow slots, or micro-slots, across its width. The gripping devices which are located in the area of the guide mechanism include a series of narrow fingers, or micro-fingers, across their width. The micro-fingers of the gripping mechanisms are designed to pass through the micro-slots of the guide mechanism. The guide mechanism is designed to constrain movement of the open edge of the folded signature away from the transfer mechanism across any gap between transfer mechanisms, thereby preventing dog-earring of the open edges of the folded signatures or books as they are transferred between transfer mechanisms.

In the method of the present invention, folded signatures or books are transferred between a transfer mechanism and a guide mechanism which is located at least in the area of the open edges of the folded signature or book. The guide mechanism include a series of narrow slots or micro-slots across its width, each of which extend along the length of the guide mechanism. A transfer gripper, including a series of narrow fingers or micro-fingers, is used to grip the folded signature or book before it emerges from an end of the guide mechanism. The micro-fingers of the transfer mechanism pass through the micro-slots in the guide mechanism to thereby allow the folded signature or book to be gripped before it emerges from the end of the guide mechanism.

BRIEF DESCRIPTION OF THE DRAWINGS

Other objects and advantages of the invention will be apparent from the specification and claims, when considered in connection with the attached sheets of drawings, illustrating different forms of the invention, wherein like characters represent like parts and in which:

DETAILED DESCRIPTION OF THE INVENTION

Figure 1:
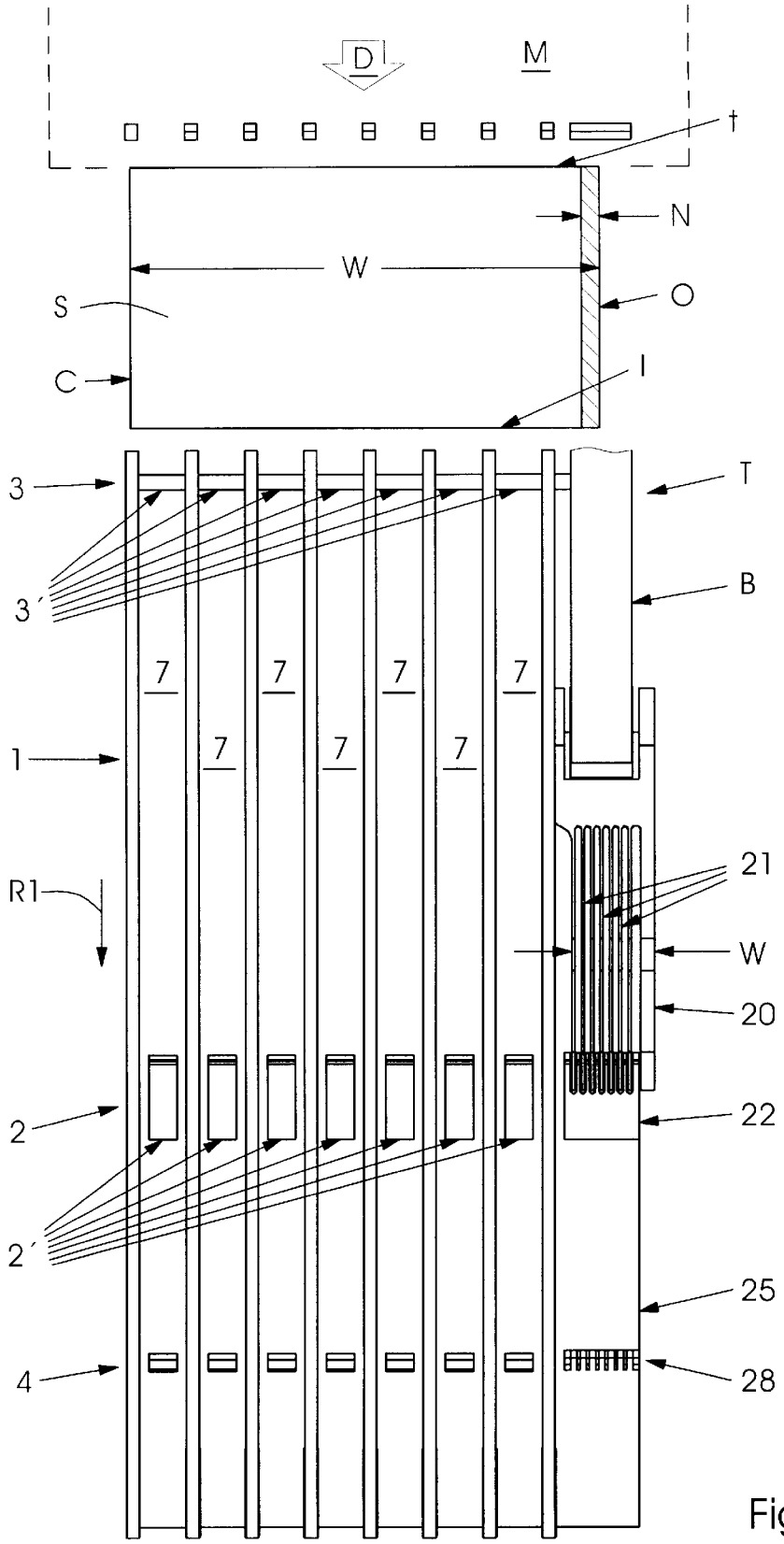
FIG. 1 is a top plan schematic view of a transfer mechanism, which includes the subject matter of the present invention.

FIG. 1 shows top plan view of a folded signature or book S which is emerging from a cutting and folding mechanism M in a direction D toward a divert cylinder 1. The folded signature or book S includes a closed or folded edge F, an open edge O, a leading edge l and a trailing edge t. The folded signature or book S, because of variations which occur during the cutting and folding processes which are performed in the cutting and folding mechanism M, can have variations in its folded width W. These possible variations in the folded width W are indicated by the variation dimension v in FIG. 1, which dimension is shaded in FIG. 1.

Upon emerging from the cutting and folding mechanism M, the folded signature or book S is conveyed by a tape drive T including at least one belt B. The belt B is partially cut away in FIG. 1. In the embodiment shown in FIG. 1, the belt B is aligned with the open edge O of the folded signature or book S, and is of a width which ensures that the open edge O is contacted by the belt B, no matter what the variation v in any particular folded signature or book S fed to the belt B. As a result, the belt B constrains the open edge O and prevents dog-earring as the folded signature or book S is transferred by the belt B.

Figure 2:
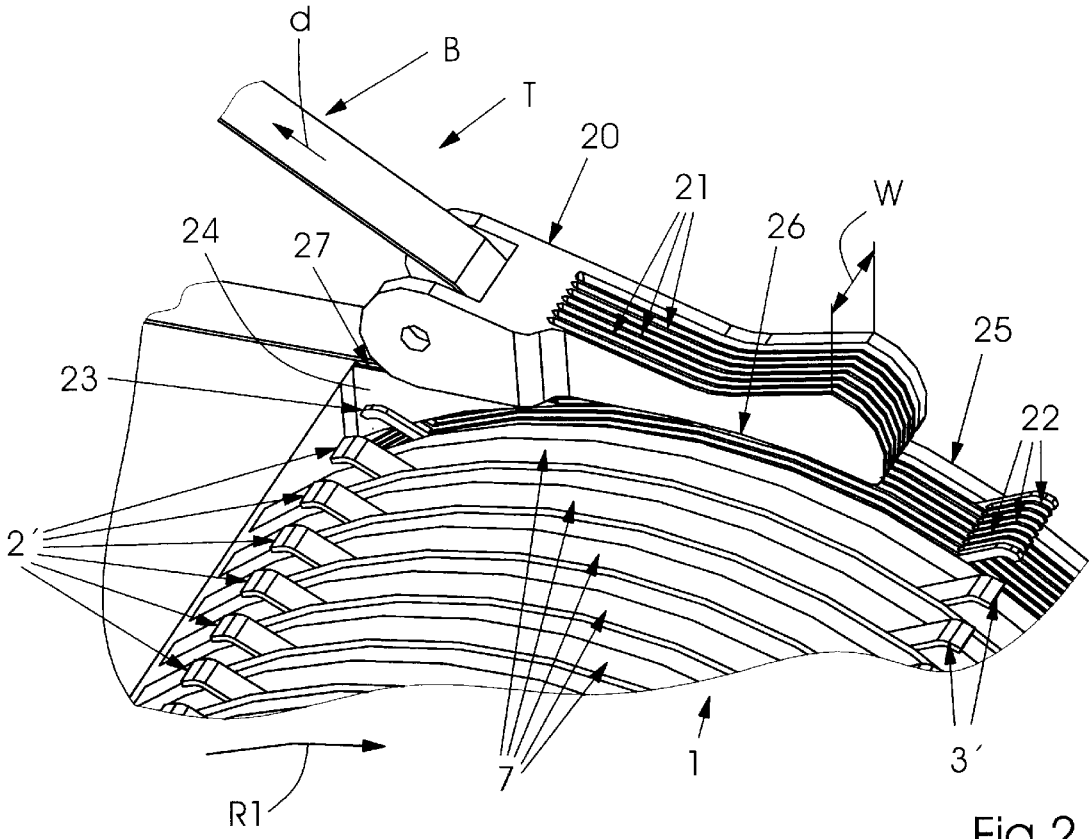
FIG. 2 is a partial perspective view of the subject matter of the present invention.
Figure 5:
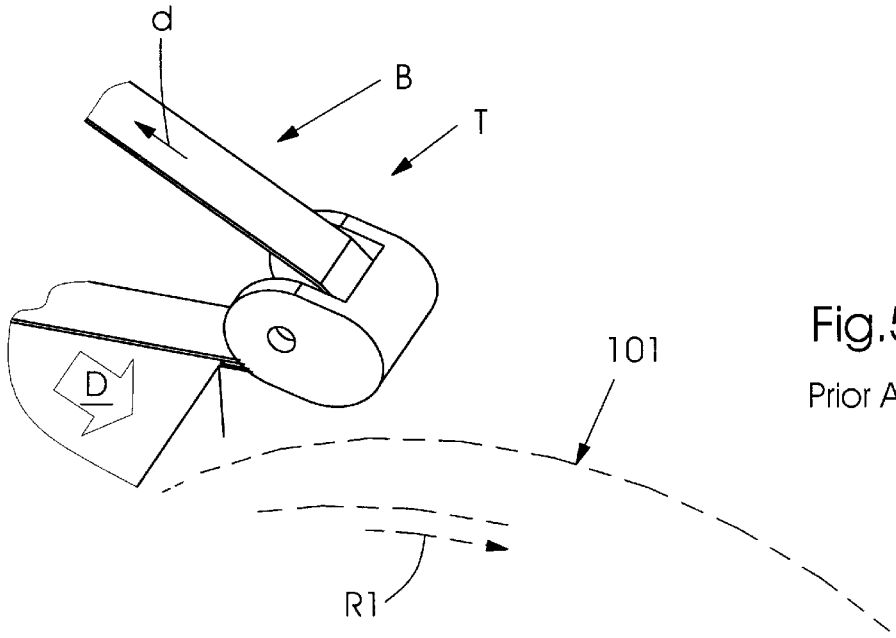
Fig.5 Prior Art
FIG. 5 is a partial perspective view of a prior art transfer mechanism.

The tape drive T transfers the folded signature or book S to the divert cylinder 1. The divert cylinder 1 rotates in a direction R1 and includes leading edge grippers 2 and trailing edge grippers 3 alternating around its circumference. The leading edge grippers 2 and trailing edge grippers 3 include a series of fingers 2' or 3' mounted in slots 7 extending around the circumference of the divert cylinder 1, as shown in FIGS. 1 and 2. The leading edge grippers 2 and trailing edge grippers 3 are pivotally mounted to the divert cylinder 1 so that they may pivot toward the divert cylinder 1 to grip a leading l or trailing t edge of alternating folded signatures or books S emerging from tape drive T. Variations in the folded width W of the folded signatures or books S may be accommodated by the fingers 2' or 3' together with the guide mechanism 20 described below, so as to accommodate different standard product book widths. The closed side C can be placed along the width of the divert cylinder 1 at a location at which the closed side C is ideally situated near one of the fingers 2' or 3', while the open edge O is arranged to be located below the guide mechanism 20. As a result, the edges C, O are located so as to be ideally constrained, no matter what the width W or variation v.

Mounted above an open side end 25 of divert cylinder 1 is a guide mechanism 20. As may be more clearly seen in FIGS. 2 and 3, the guide mechanism 20 may, at one end, be mounted to, or house, the pulley for the belt B of the tape drive T. At the opposite end of the guide mechanism 20, the guide mechanism 20 includes a series of narrow slots or micro-slots 21 across the width of the guide mechanism 20 and extending in the direction of rotation R1 of the divert cylinder 1. The lower surface 26 of the guide mechanism 20 is closely adjacent to, and follows the contour of, the outer circumference of the divert cylinder 1. This configuration of the lower surface 26 ensures that the open edge O of any signature is constrained between the outer circumference of the divert cylinder 1 and the lower surface 26 of the guide mechanism 20, thereby preventing dog-earring of the corners C of the folded signature or book S.

The width w of the guide mechanism 20 is selected so that it accommodates variations v in the folded width W of the folded signature or book S. The width w therefore ensures that the guide mechanism will be above the open edge O of the folded signature or book S despite any variation v in the folded width W.

The portion of the leading edge grippers 2 and trailing edge grippers 3 which are adjacent the open side end 25 of divert cylinder 1 is in the form of a series of narrow fingers or micro-fingers 22 which are positioned so as to be aligned with and pass through micro-slots 21 as the divert cylinder 1 rotates in direction R1, and which are adjacent the open edge O of the folded signature or book. In this manner, there is no interference between the operation of the leading edge grippers 2 and trailing edge grippers 3, and the guide mechanism 20 as the leading edge grippers 2 and trailing edge grippers 3 grip leading l and trailing t edges of the folded signatures or books S as they exit from the tape drive T. A lower guide bracket 24 which is located between the tape drive T and the divert cylinder 1 also contains a series of narrow slots or micro-slots 27, through which the series of narrow fingers or micro-fingers 22 pass as the divert cylinder 1 rotates in direction R1. This lower bracket 24 provides support to a lower side of a folded signature or book S in the tape drive T before the folded signature or book S contacts the outer circumference of the divert cylinder 1. The series of narrow fingers or micro-fingers 22 form a part of the leading edge grippers 2 and trailing edge grippers 3, and pivot with the fingers 2' or 3' as they pivot to grip and release the leading l or trailing t edge of a folded signature or book S.

Figure 3:
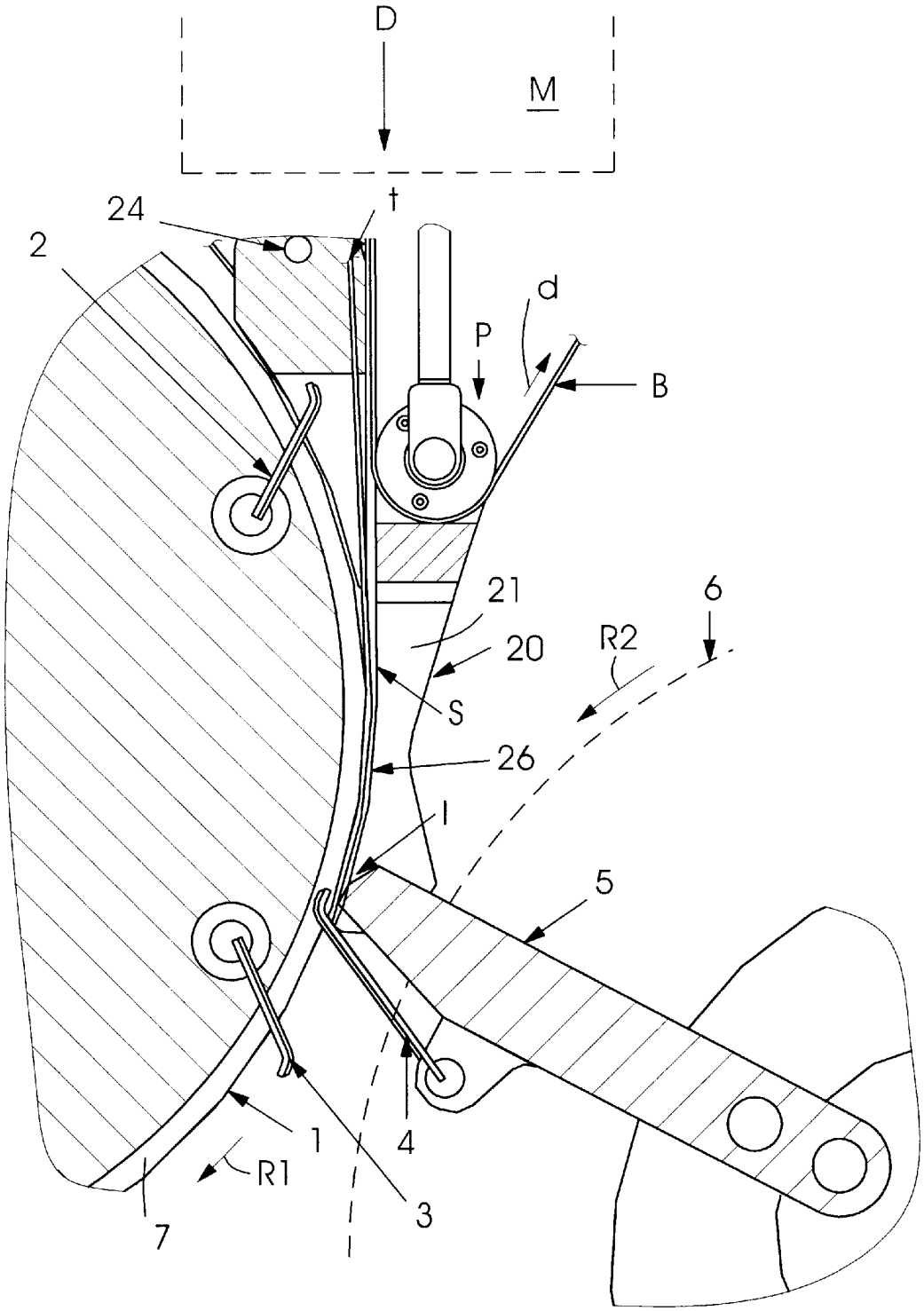
FIG. 3 is a partial cross-sectional side elevation view of the subject matter of the present invention.
Figure 4:
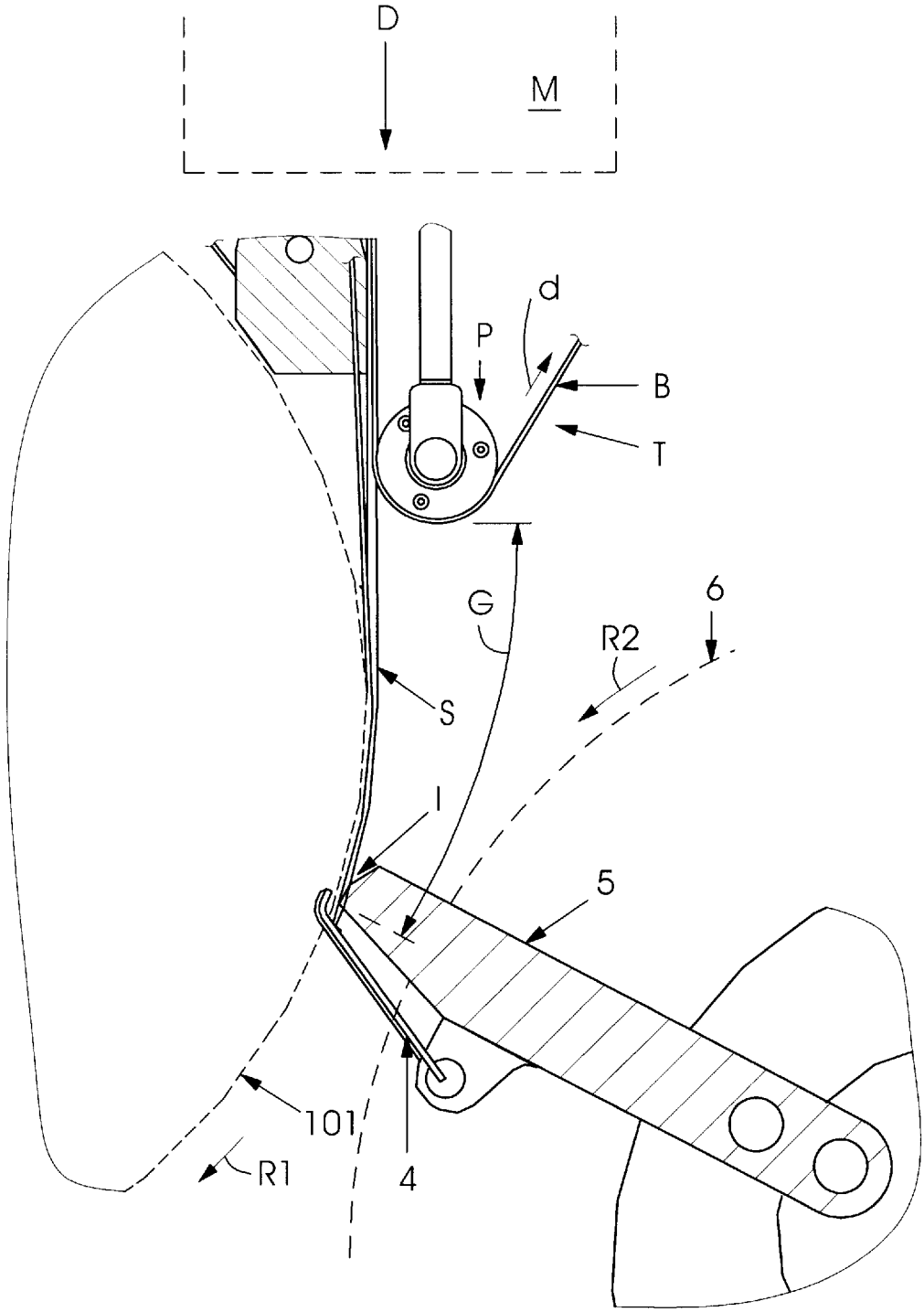
Fig.4 Prior Art
FIG. 4 is a partial cross-sectional side elevation view of a prior art transfer mechanism.
Figure 6:
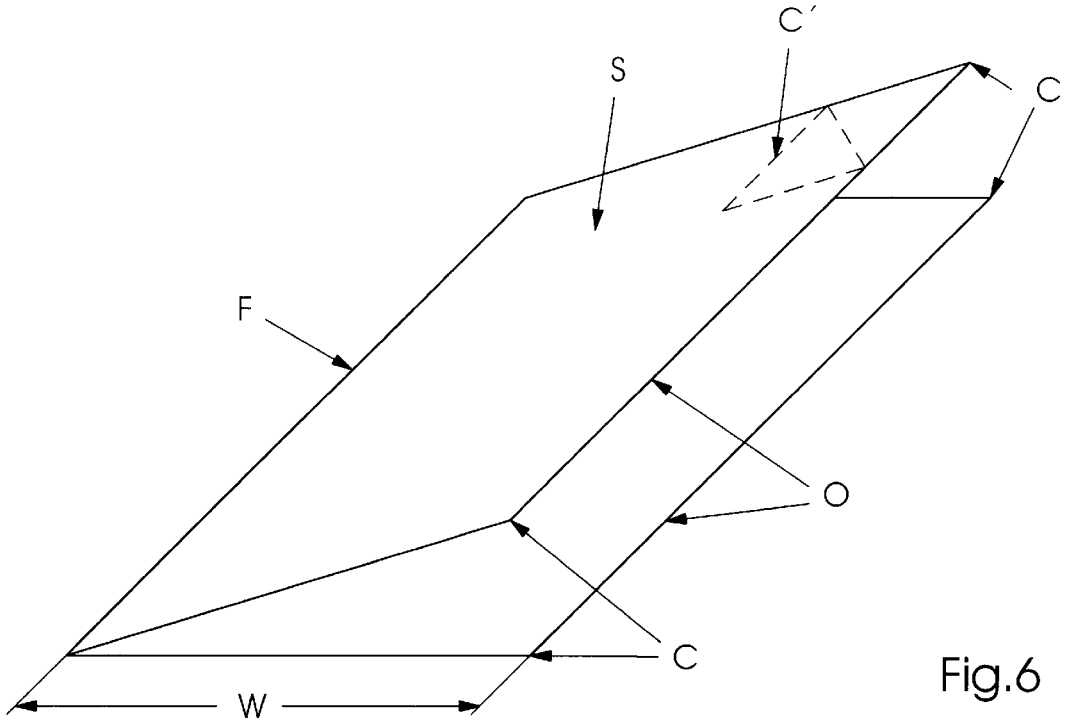
Fig.6 Prior Art
FIG. 6 is a perspective view of a folded signature or book of the prior art which is used in the present invention.

As may be seen in FIG. 3, the guide mechanism 20 extends past the point where the deceleration drum 6 grips the leading edge l of the folded signature or book S, thereby ensuring that the folded signature or book S is constrained between the guide mechanism 20 and the divert cylinder 1 during the entire distance traveled by the folded signature or book S between the tape drive T and the deceleration drum 6. As shown in FIG. 1, in order to prevent interference between the edge gripping mechanism 4, 5 of the deceleration drum 6 and the guide mechanism 20, the side of the edge gripping mechanism 4, 5 of the deceleration drum 6 includes narrow fingers or micro-fingers 28 on the open side end 25 of divert cylinder 1. These micro-fingers 28, like micro-fingers 22, are aligned with and pass through narrow slots or micro-slots 27 as the deceleration drum 6 rotates in direction R2.

In the method of the present invention, a signature, which may be in the form of a folded signature or book S, is transported using a transportation device, such as a tape drive T. The signature is then transferred to a transfer device, such as a divert cylinder 1 or a deceleration drum 6. As the signature is transferred between the transportation device and the transfer device, at least one edge of the signature, such as the open edge O, is guided by a guide mechanism 20. Gripping mechanisms, such as the micro-fingers 22 or 28, pass through micro-slots 21 on the guide mechanism as the signature is guided by the guide mechanism 20 and grip the leading l or trailing t edge of the signature before it exits from the guide mechanism 20. In this way, the signature is always guided by the guide mechanism 20 until it is securely gripped by a gripper 2, 3 or 4, 5, In particular the open edge O is constrained from dog-earring, at all times before it is gripped by the guide mechanism 20, no matter what the variation v in the folded width W of the folded signature or book S.

Guide mechanism 20 is ideally made of a material which will not cause a jamming or catastrophic failure if one of the micro-fingers 22 or 28 is bent out of alignment with the micro-slots 21. The guide mechanism 20 could therefore be manufactured of a resilient or non-rigid material such as rubber or plastic, or the guide mechanism 20 could be in the form of a brush with micro-slots 21 or be made of a foam or other resilient or non-rigid material.

As will be appreciated by one of ordinary skill in the art, the embodiments disclosed herein are not meant to be exclusive. In particular, but without limiting other variations, the preferred embodiment disclosed could be used to constrain any edge of a signature or sheet or any other flexible items, whether folded or not, and could be used in any form of transfer mechanism, and is not limited to a divert cylinder or a deceleration drum. It is the claims which define the scope of the present invention.

What is claimed is:

1. An apparatus for constraining an open edge of a folded signature in a printing press, comprising:

a cylinder including an outer surface, the cylinder transferring the folded signature on the outer surface;

a guide mechanism, the guide mechanism being located closely adjacent to and conforming with the outer surface of the cylinder, the guide mechanism overlapping the open edge of the folded signature, the guide mechanism thereby constraining the open edge as the folded signature is transferred on the outer surface.

2. The apparatus of claim 1, wherein:

the cylinder includes at least one gripper.

3. The apparatus of claim 2, wherein:

the guide mechanism includes at least one slot and the at least one gripper includes at least one finger adjacent the open edge of the folded signature, the at least one finger being aligned with and passing through the at least one slot.

4. The apparatus of claim 3, wherein:

the guide mechanism includes a plurality of slots and the at least one gripper includes a plurality of fingers adjacent the open edge of the folded signature, the plurality of fingers being aligned with and passing through the plurality of slots.

5. The apparatus of claim 1, wherein:

the cylinder is a divert cylinder including a plurality of leading edge grippers and a plurality of trailing edge grippers.

6. The apparatus of claim 1, further comprising:

a deceleration drum, the deceleration drum gripping folded signatures on the outer surface of the cylinder.

7. The apparatus of claim 1, further comprising:

a transport mechanism, the transport mechanism feeding the folded signatures to the cylinder.

8. The apparatus of claim 7, wherein:

the transport mechanism includes at least one belt.

9. The apparatus of claim 8, wherein:

the at least one belt overlaps the open edge of the folded signature.

10. A method for constraining an open edge of a folded signature in a printing press, comprising:

feeding the folded signature to a cylinder;

transferring the folded signature on an outer surface of the cylinder;

constraining the folded signature between the outer surface of the cylinder and a guide mechanism located closely adjacent to the outer surface of the cylinder mechanism and overlapping the open edge of the folded signature.

11. The method of claim 10, further comprising:

gripping the folded signature as the folded signature is constrained between the outer surface of the transfer mechanism and the guide mechanism.

12. The method of claim 11, further comprising:

passing at least one finger of a gripper through at least one slot in the guide mechanism.

13. The method of claim 12, wherein:

passing a plurality of fingers of the gripper through a plurality of slots in the guide mechanism.

14. The method of claim 10, wherein:

transporting the flat article using at least one belt.

15. The method of claim 14, further comprising:

overlapping the edge of the at least one flat article with the at least one belt.

* * * * *